US012637912B2

(12) United States Patent
Flores et al.

(10) Patent No.: US 12,637,912 B2
(45) Date of Patent: May 26, 2026

(54) REDUCING VIBRATION OF AN ELECTRIC SUBMERSIBLE PUMP

(71) Applicant: Saudi Arabian Oil Company, Dhahran (SA)

(72) Inventors: Marcelo Ramos Flores, Udhailiyah (SA); Alaa Shawly, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/187,384

(22) Filed: Apr. 23, 2025

(65) Prior Publication Data

US 2025/0250868 A1 Aug. 7, 2025

Related U.S. Application Data

(62) Division of application No. 18/301,658, filed on Apr. 17, 2023, now Pat. No. 12,320,210.

(51) Int. Cl.

| | |
|---|---|
| ***E21B 17/10*** | (2006.01) |
| ***E21B 23/03*** | (2006.01) |
| ***E21B 43/12*** | (2006.01) |

(52) U.S. Cl.

CPC ..... *E21B 17/1078* (2013.01); *E21B 23/03* (2013.01); *E21B 43/128* (2013.01)

(58) Field of Classification Search

CPC .. E21B 17/1078; E21B 17/1085; E21B 23/03; E21B 43/128; E21B 19/07; E21B 19/10; E21B 33/0422; E21B 33/1265; E21B 33/129

See application file for complete search history.

(56) References Cited

U.S. PATENT DOCUMENTS

| | | | | |
|---|---|---|---|---|
| 10,400,535 | B1 * | 9/2019 | Greenlee | E21B 33/128 |
| 2011/0308820 | A1 * | 12/2011 | Greenlee | E21B 33/1295 166/387 |
| 2014/0190682 | A1 * | 7/2014 | Greenlee | E21B 33/13 166/118 |
| 2014/0216722 | A1 * | 8/2014 | Badrak | C23C 14/46 166/206 |
| 2016/0061010 | A1 * | 3/2016 | Sears | E21B 43/128 166/66.4 |

* cited by examiner

*Primary Examiner* — Yong-Suk (Philip) Ro
(74) *Attorney, Agent, or Firm* — Fish & Richardson P.C.

(57) ABSTRACT

An electric submersible pump assembly that has a motor, a pump, and a slip assembly. The pump is driven by the motor to flow production fluid up the wellbore through a wellbore string. The slip assembly is attached to the electric submersible pump assembly and resides downhole of the motor. The slip assembly has a first slip and a second slip. The first slip is coupled to the electric submersible pump assembly at or downhole of the motor. The first slip is flexible and engages, with the second slip set, the wall of the wellbore to dampen a vibration of the motor. The second slip is coupled to the electric submersible pump assembly at or downhole of the motor, and is set on a wall of the wellbore, securing the electric submersible pump assembly to the wall of the wellbore.

13 Claims, 2 Drawing Sheets

REDUCING VIBRATION OF AN ELECTRIC SUBMERSIBLE PUMP

CROSS-REFERENCE TO RELATED APPLICATION(S)

This application is a divisional of U.S. patent application Ser. No. 18/301,658, filed Apr. 17, 2023, the contents of which are hereby incorporated by reference.

FIELD OF THE DISCLOSURE

This disclosure relates to electric submersible pumps.

BACKGROUND OF THE DISCLOSURE

Electric submersible pumps are used in oil and gas production to lift hydrocarbons from a downhole location of a wellbore to the terranean surface of the wellbore. Electric submersible pumps have motors and other components that vibrate or move during production, which can lead to operational issues and reduce the life of the electric submersible pump. Methods and equipment to improve electric submersible pumps are sought.

SUMMARY

Implementations of the present disclosure include an electric submersible pump assembly that has a motor, a pump, and a slip assembly. The motor is coupled to a wellbore string disposed within a wellbore. The pump is coupled to the wellbore string and resides between the motor and the wellbore string. The pump is driven by the motor to receive a production fluid from an intake of the electric submersible pump assembly and flow the production fluid up the wellbore through the wellbore string. The slip assembly is attached to the electric submersible pump assembly and resides downhole of the motor. The slip assembly has a first slip and a second slip. The first slip is coupled to the electric submersible pump assembly at or downhole of the motor. The first slip is flexible and engages, with the second slip set, the wall of the wellbore to dampen a vibration of the motor. The second slip is coupled to the electric submersible pump assembly at or downhole of the motor, and is set on a wall of the wellbore, securing the electric submersible pump assembly to the wall of the wellbore.

In some implementations, the electric submersible pump assembly further includes a third slip. The first slip, second slip, and third slip are substantially equidistant from each other. The third slip is coupled to the electric submersible pump assembly at or downhole of the motor. The third slip is rigid and sets on a wall of the wellbore, further securing the electric submersible pump assembly to the wall of the wellbore. In some implementations, the second slip and third slip prevent the motor from substantially moving axially, and the first slip reduces a radial and axial vibration of the motor. In some implementations, the first slip includes a damper including at least one of a rubber element or a spring configured to bear against the wall of the casing. The damper absorbs the kinetic energy released by the motor while vibrating.

In some implementations, the second slip includes a rigid slip has teeth that bite into the wall of the casing to fix the electric submersible pump assembly to the wall of the casing.

In some implementations, the second slip is set mechanically, hydraulically, or electrically.

In some implementations, the first slip and second slip reside at a common elevation along the electric submersible pump assembly. In some implementations, the slip assembly includes a tube coupled to a downhole end of the motor, and the first slip and second slip are attached to the tube.

Implementations of the present disclosure include an assembly that includes a wellbore tool disposed within a wellbore and a slip assembly attached to the wellbore tool. The slip assembly includes a first slip and a second slip. The first slip is coupled to wellbore tool and has a damper that resides between the first slip and a wall of the wellbore to absorb energy produced by vibration of the wellbore tool. The second slip is set on a wall of the wellbore, securing the wellbore tool to the wall of the wellbore.

In some implementations, the slip assembly further includes a third slip with the first slip, second slip, and third slip substantially equidistant from each other and residing along a common elevation with respect to the wellbore tool, the third slip being rigid and configured be set on a wall of the wellbore, further securing the electric submersible pump assembly to the wall of the wellbore. In some implementations, the second slip and third slip prevent the motor from substantially moving axially, and the first slip reduces or controls a radial and axial vibration of the motor.

In some implementations, the damper includes at least one of a rubber element or a spring configured to bear against the wall of the casing, the damper configured to absorb the kinetic energy released by the motor while vibrating.

In some implementations, the second slip includes a rigid slip including teeth configured to bite into the wall of the casing to fix the electric submersible pump assembly to the wall of the casing.

In some implementations, the wellbore tool includes a submersible pump, and the slip assembly is coupled to a downhole end of a motor of the submersible pump.

Implementations of the present disclosure include a method that includes obtaining a wellbore tool. The wellbore tool has a slip assembly including a first slip and a second slip. The first slip has a damper and the second slip can be set on a wall of the wellbore, securing the wellbore tool to the wall of the wellbore. The method also includes disposing the wellbore tool within a wellbore. The method also includes activating the second slip to engage a wall of the wellbore and secure the wellbore tool to a wall of the wellbore. The first slip bears, with the second slip set, against the wall of the wellbore and against the wellbore tool to dampen a vibration of the wellbore tool.

DETAILED DESCRIPTION OF THE DISCLOSURE

The present disclosure describes an electric submersible pump assembly that reduces or eliminates the vibration of the motor of the electric submersible pump. The electric submersible pump assembly has a damper with slips that dissipates the energy of oscillations at and below the motor to an acceptable level. Vibration can be an indirect measurement of the performance of electric submersible pumps. For example, like vibration can be cause by or include mechanical (e.g. sand, wear), electrical (e.g. frequency) and hydraulic (e.g. gas, viscosity) components. This makes it difficult to interpret an exact, absolute value of vibration of the motor. However, the trend of vibration of the motor can indicate a range of problem conditions or change in normal operating conditions. The electric submersible pump assembly of the present disclosure can reduce vibration of the motor and other components to reduce problems and maintain normal operating conditions.

Particular implementations of the subject matter described in this specification can be implemented so as to realize one or more of the following advantages. For example, the electric submersible pump assembly of the present disclosure can reduce operational issues related to vibration and extend the run life of the electric submersible pump assembly.

Figure 1:
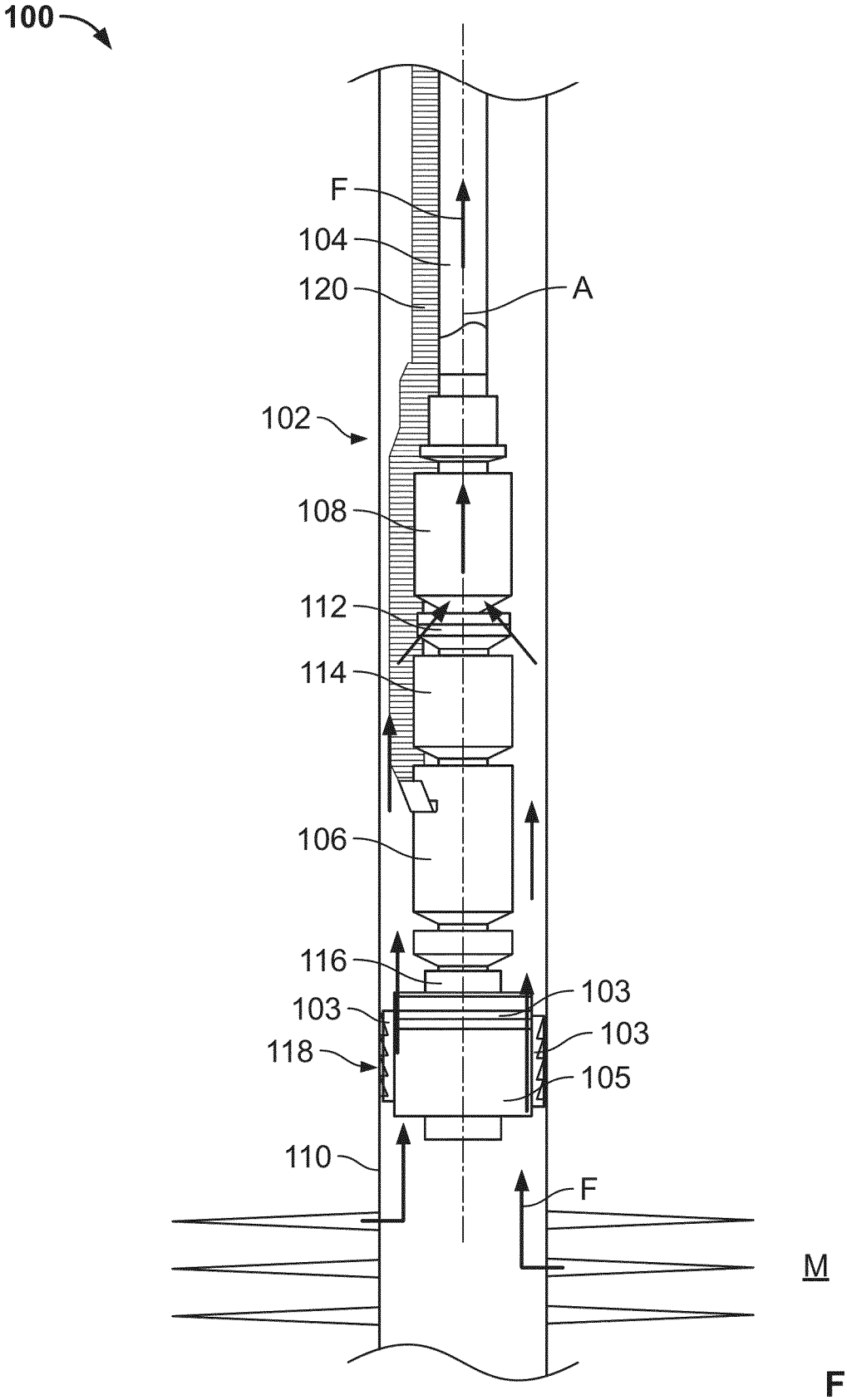
FIG. 1 is a perspective, schematic view of a valve assembly according to an embodiment of the present disclosure.

FIG. 1 shows a wellbore assembly 100 (e.g., an electric submersible pump assembly) disposed within a wellbore 110. The wellbore assembly 100 includes a wellbore string 104 attached to an electric submersible pump (ESP) 102. The ESP 102 has a motor 106, a pump 108, an intake 112, a seal or protector 114, a sensor 116, and a vibration suppressor 118 (e.g., a slip assembly) that has multiple slips 103. In some implementations, the wellbore assembly 100 can include a different wellbore tool or equipment such as a packer, a valve, or production tubing.

The pump 108 is coupled to the wellbore string 104. The pump 108 is driven by the motor 106 to receive a production fluid "F" from the intake 112 and flow the production fluid "F" up the wellbore 110 through the wellbore string 104. The production fluid "F" flows from a formation "M" and can include water, hydrocarbons, and other formation fluids.

The motor 106 is an electric ESP motor such as an induction AC motor or a permanent magnet motor. The motor 106 can be powered by a power source electrically connected to the motor 106 through one or more cables 120 (e.g., a power cable). Additionally, the one or more cables 120 can be used to transmit information or instructions to other parts of the ESP 102, such as the vibration suppressor 118 to activate the slips 103 of the vibration suppressor 118.

The vibration suppressor 118 is attached to a downhole end of the motor 106 or the sensor 116. In some implementations, the vibration suppressor 118 can be attached above the motor 106, at the motor, or in a different location along the ESP 102.

The vibration suppressor 118 has a tube 105 or housing and multiple slips 103 that extend from the housing 105. A horizontal slip 103 can be or include a damper to reduce noise and vibration. The tube 105 can be threadedly attached or otherwise coupled to the downhole end of the ESP 102, near the motor 106.

Figure 2:
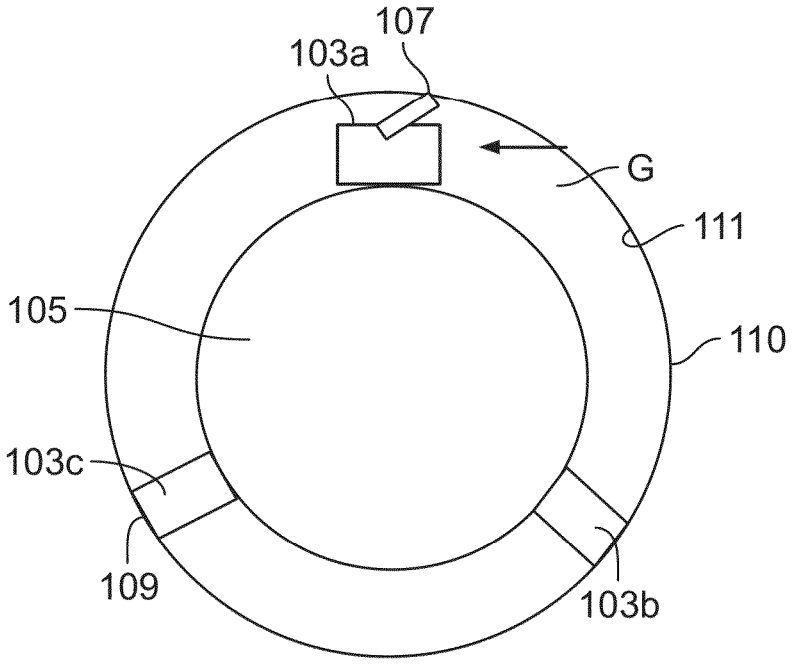
FIG. 2 is a partially cross-sectional, schematic view of a portion of a valve in an open position.

Referring also to FIG. 2, the vibration suppressor includes a first slip 103*a*, a second rigid slip 103*b*, and a third rigid slip 103*c*. The first slip 103*a* is a type of floating slip 103*c* or flexible slip. For example, the first slip 103*a* has a damper 107 such as a rubber element, a spring, or another flexible or elastic material that engages or bears against the wall 111 of the wellbore 110 to dampen or reduce a vibration of the motor (e.g., by converting vibrational energy into heat). The damper 107 is attached to the slip 103*a* and pushes against the wellbore to absorb the kinetic energy released by the motor while vibrating. For example, the slip 103*a* bears against the tube 105 such that the damper 107 is snugged between the slip 103*a* and the wellbore 110 to reduce the vibration of the motor 106 during operation (e.g., during production). Thus, the first slip 103*a* reduces a radial and axial vibration of the motor.

The second slip 103*b* and third slip 103*c* are rigid and extend to engage the wall 111 of the wellbore similar to traditional slips (e.g., packer slips). The second slip 103*b* and third slip 103*c* have teeth 109 that bite into the casing of the wellbore 110 to secure or fix the ESP 102 (and by extension the motor 106) to the wall 111 of the wellbore 110.

In some implementations, the three slips 103*a*, 103*b*, 103*c* are substantially equidistant from each other. The slips define a gap "G" between each other at the annulus between the tube 105 and the wellbore 110 to let fluid "F" flow substantially uninterrupted up to the intake of the ESP 102. The two rigid slips 103*b*, 103*c* together secure the ESP 102 to the wellbore 110, preventing the motor 106 from substantially moving axially. For example, referring back to FIG. 1, the rigid slips 103*b*, 103*c*, prevent the motor 106 from substantially moving along the central axis "A" of the ESP 102.

The slips 103*a*, 103*b*, 103*c* are set hydraulically, mechanically, or electrically. In some implementations, only the rigid slips 103*b*, 103*c* are set or extended while the floating slip 103*b* remains in one position. The tube 105 can be fluidly coupled to the wellbore string 104, and fluid from the wellbore string 104 can be flown at a sufficient pressure to expand the slips 103*b*, 103*c*. In some embodiments, the slips 103*b*, 103*c* can be set mechanically by pulling the ESP 102 uphole from the surface.

Figure 3:
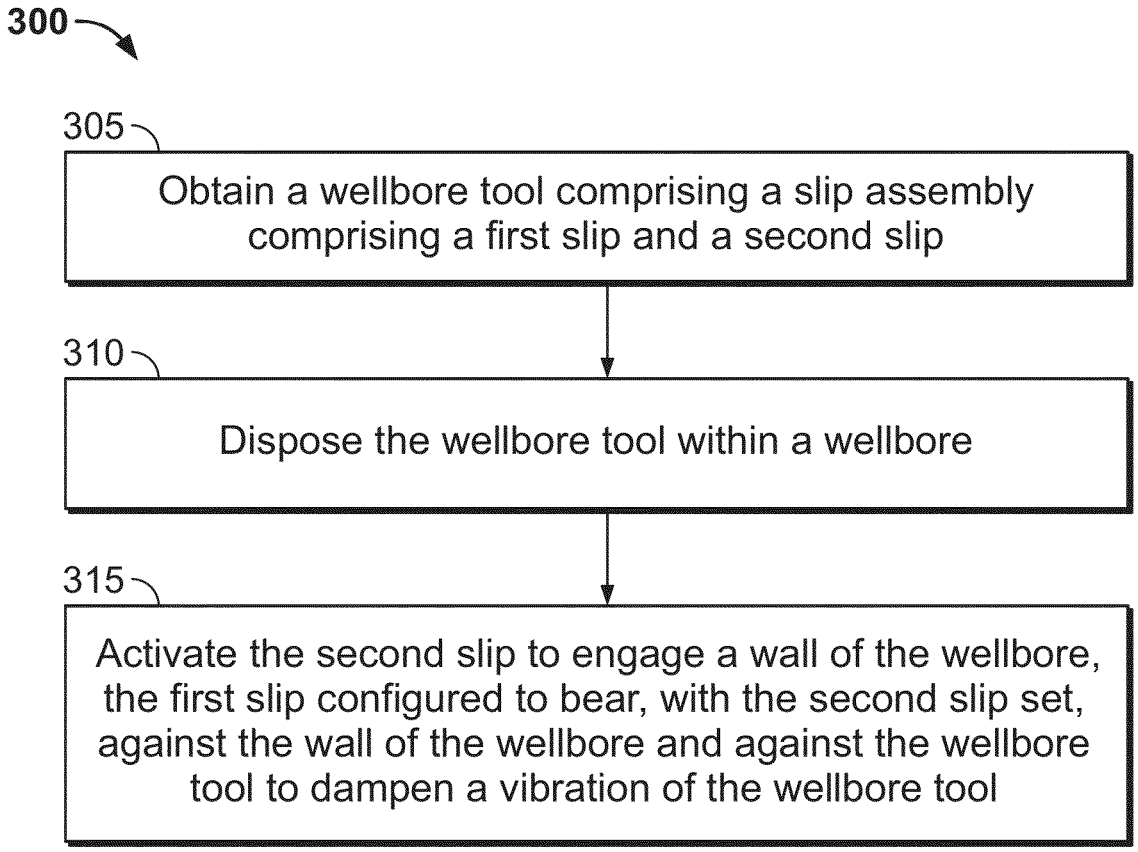
FIG. 3 is a flow chart of a method of reducing the vibration of an electric submersible pump.

FIG. 3 shows a flow chart of an example method 300 of reducing or eliminating the vibration of an ESP motor. The method includes obtaining a wellbore tool comprising a slip assembly comprising a first slip and a second slip, the first slip comprising a damper and the second slip configured to be set on a wall of the wellbore, securing the wellbore tool to the wall of the wellbore (305). The method also includes disposing the wellbore tool within a wellbore (310). The method also includes activating the second slip to engage a wall of the wellbore and secure the wellbore tool to a wall of the wellbore, the first slip configured to bear, with the second slip set, against the wall of the wellbore and against the wellbore tool to dampen a vibration of the wellbore tool (310).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations. For example, the implementations are described with reference to an electric submersible pump (ESP). However, the disclosure can be implemented with any wellbore equipment that is susceptible to vibration, such as production tubing, valves, or packers.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A wellbore assembly, comprising:

a wellbore tool configured to be disposed within a wellbore; and a slip assembly configured to be attached to the wellbore tool, the slip assembly comprising:

a first slip coupled to the wellbore tool, the first slip comprising a flexible damper residing between the first slip and a wall of the wellbore to absorb, with the wellbore tool set on the wellbore, energy produced by vibration of the wellbore tool, a second slip coupled to the wellbore tool, the second slip configured to engage a wall of the wellbore, setting the wellbore tool on the wellbore; and a third slip spaced from the first and second slips, the second and third slips configured to be set on the wall of the wellbore to secure the wellbore tool to the wellbore;

wherein the flexible damper is configured to bear, with the second and third slips set, against the wall of the wellbore to dampen a vibration of the wellbore tool.

2. The wellbore assembly of claim 1, wherein the first slip, second slip, and third slip are positioned substantially equidistant from each other and residing along a common elevation with respect to the wellbore tool, the third slip being rigid and configured be set on the wall of the wellbore, further securing the wellbore tool to the wall of the wellbore.

3. The wellbore assembly of claim 2, wherein the second slip and third slip prevent the wellbore tool from substantially moving axially, and the first slip reduces a radial and axial vibration of the wellbore tool.

4. The wellbore assembly of claim 1, wherein the damper comprises at least one of a rubber element or a spring configured to bear against the wall of a casing of the wellbore, the damper configured to absorb the kinetic energy released by the wellbore tool while vibrating.

5. The wellbore assembly of claim 1, wherein the second slip comprises a rigid slip comprising teeth configured bite, with the slip extended or activated, into the wall of a casing of the wellbore to fix the wellbore tool to the wall of the casing.

6. The wellbore assembly of claim 1, wherein the wellbore tool comprises a submersible pump, and the slip assembly is coupled to a downhole end of a motor of the submersible pump.

7. The wellbore assembly of claim 1, wherein the second and third slips are rigid slips each comprising teeth configured to bite into the wall of a casing of the wellbore to fix the electric submersible pump assembly to the wall of the casing.

8. The wellbore assembly of claim 1, wherein the second and third slips are configured to be set mechanically, hydraulically, or electrically.

9. A method, comprising:

obtaining a wellbore tool comprising a slip assembly comprising a first slip and a plurality of slips, the first slip comprising a flexible damper;

disposing the wellbore tool within a wellbore;

activating the plurality of slips to be set on and engage a wall of the wellbore and secure the wellbore tool to a wall of the wellbore, the flexible damper of the first slip configured to bear, with the plurality of slips set, against the wall of the wellbore; and dampening, with the flexible damper bearing against the wall of the wellbore, a vibration of the wellbore tool.

10. The method of claim 9, further comprising preventing, with the plurality of slips, the wellbore tool from substantially moving axially.

11. The method of claim 10, further comprising reducing, with the first slip, a radial and axial vibration of the wellbore tool.

12. The method of claim 9, wherein the flexible damper comprises at least one of a rubber element or a spring configured to bear against the wall of a casing of the wellbore, the method further comprising absorbing, with the flexible damper, at least part of the kinetic energy released by the wellbore tool while vibrating.

13. The method of claim 9, wherein the plurality of slips each are rigid slips comprising teeth, and the activating comprises biting, with the slip extended, into the wall of a casing of the wellbore with the plurality of rigid slips to fix the wellbore tool to the wall of the casing.

* * * * *